US005779154A

United States Patent [19]

Martin

[11] Patent Number: 5,779,154

[45] Date of Patent: Jul. 14, 1998

[54] GARDEN SPRINKLER ADAPTER DEVICE

[76] Inventor: Blake T. Martin, 2800 Keego Rd., Brewton, Ala. 36426

[21] Appl. No.: 736,003

[22] Filed: Oct. 23, 1996

[51] Int. Cl.[6] ..... B05B 7/24

[52] U.S. Cl. ..... 239/315; 239/310

[58] Field of Search ..... 239/315, 316, 239/374, 375, 376, 377, DIG. 23; 222/481.5, 494, 491, 479, 500, 478, 468; 137/527.6, 521

[56] References Cited

U.S. PATENT DOCUMENTS

| | | | |
|---|---|---|---|
| 1,806,025 | 5/1931 | Seaman | 239/315 |
| 1,958,038 | 5/1934 | Fraser | 299/144 |
| 2,249,274 | 7/1941 | Faine | 299/141 |
| 2,552,352 | 5/1951 | Swanson | 299/141 |
| 2,657,951 | 11/1953 | North, Jr. | 299/101 |
| 5,232,110 | 8/1993 | Purnell | 215/312 |
| 5,301,846 | 4/1994 | Schmitz | 222/211 |

FOREIGN PATENT DOCUMENTS

| | | | |
|---|---|---|---|
| 6-090629 | 4/1994 | Japan | 239/315 |

*Primary Examiner*—Lesley D. Morris
*Assistant Examiner*—David Deal
*Attorney, Agent, or Firm*—Henderson & Sturm

[57] ABSTRACT

A garden sprinkler adapter device (10) for converting a conventional receptacle (40) into a garden sprinkler that dispenses both water and dissolved fertilizer. The device has an upper portion (22) provided with a recessed screen (23) and dimensioned to receive a fertilizer disk (30). An aperture cap element (27) is operatively engaged with the upper portion (22) and a lower threaded portion (21) is attached to the conventional receptacle (40).

4 Claims, 2 Drawing Sheets

GARDEN SPRINKLER ADAPTER DEVICE

TECHNICAL FIELD

The present invention relates to the field of sprinkling apparatus in general, and in particular to a hand-held sprinkler equipped with a screw-in fertilizer dispensing adapter.

BACKGROUND ART

As can be seen by reference to the following U.S. Pat. Nos. 1,958,038; 2,249,274; 2,552,352; and 2,657,951; the prior art is replete with myriad and diverse sprinkler nozzle arrangements.

While all of the aforementioned prior art constructions are more than adequate for the basic purpose and function for which they have been specifically designed, only the North patent suggested converting a conventional jug type mouthed container into a sprinkler device.

None of the references, however, even remotely suggested the added improvement of a fertilizer holding chamber being deployed within the adapter device to provide both fertilizer and water to the plants simultaneously, while also providing a simple and secure means of loading the fertilizer receiving chamber either prior to or even while the adapter device was mounted on the conventional receptacle.

As a consequence of the foregoing situation, there has existed a longstanding need among both gardeners and plant owners for a new type of compact garden sprinkler adapter device that will convert a conventional receptacle into a sprinkler device that will apply both water and fertilizer to both indoor and outdoor plants in a simple and efficient manner. The provision of such a construction is a stated objective of the present invention.

DISCLOSURE OF THE INVENTION

Briefly stated, the garden sprinkler adapter device that forms the basis of the present invention comprises in general, a housing unit provided with a lower internally threaded portion dimensioned to engage the mouth of a milk jug receptacle or the like. IN addition, the upper end of the housing member is dimensioned to receive a fertilizer disk and further provided with external threads that engage an apertured cap member.

As will be explained in greater detail further on in the specification, a snorkel type vent tube is provided with a hinged vent flap that will prevent liquid from escaping from the vent tube, but will allow air to enter the receptacle reservoir to replace the liquid that passes over the fertilizer disk and out through the apertured cap member.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
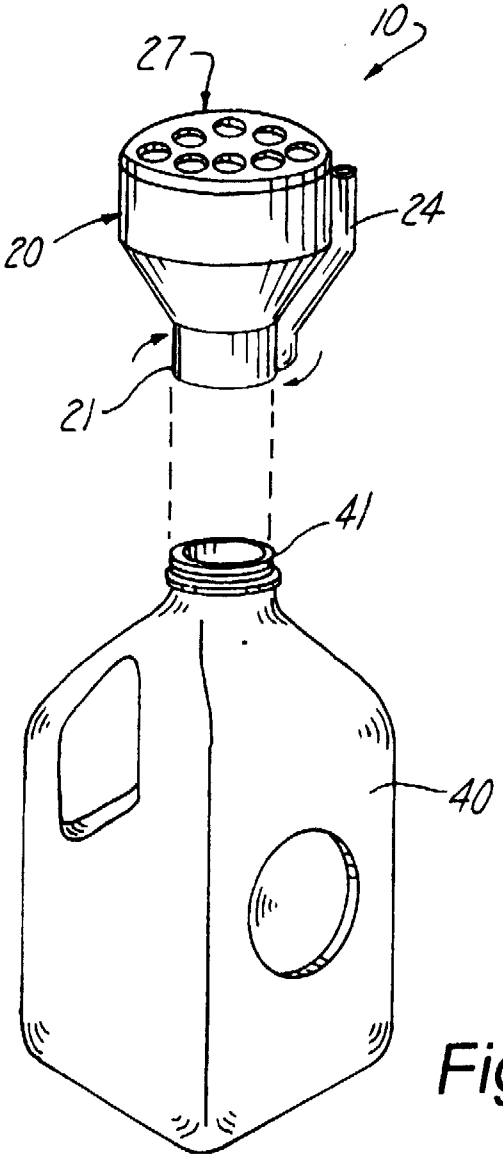
FIG. 1 is an exploded perspective view of the garden sprinkler adapter device in conjunction with a liquid receptacle.

As can be seen by reference to the drawings, and in particularly to FIG. 1, the garden sprinkler adapter device that forms the basis of the present invention is designated generally by the reference number (10). The device (10) comprises in general, an elongated contoured hollow housing unit (20), having an internally threaded lower portion (21) dimensioned to operatively engage the mouth (41) of a conventional liquid receptacle (40) such as a milk jug or the like, in a well recognized fashion.

As can best be seen by reference to FIG. 3, the housing unit (20) is also provided with an externally threaded upper portion (22) whose purpose and function will be explained further on in the specification. In addition, the upper portion (22) of the housing unit (20) is provided with a recessed screen element (23) dimensioned to receive a fertilizer disk (30). A snorkel type vent tube (24) which is disposed substantially on the exterior of the housing unit 20 and extends from just below the externally threaded upper portion (22) into the interior (25) of the housing unit (20) proximate the internally threaded lower portion (21).

Figure 4:
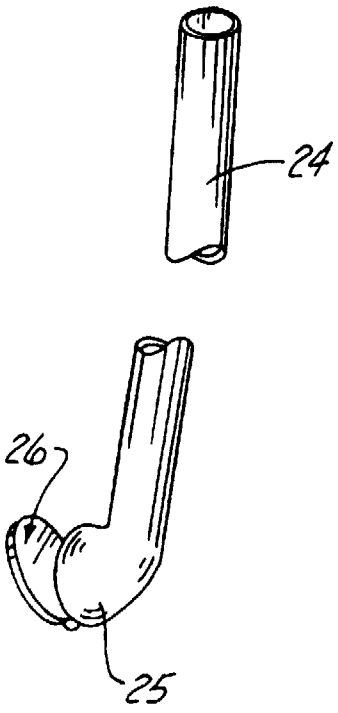
FIG. 4 is an isolated perspective view of the snorkel type vent tube.

Turning now to FIG. 4, it can be seen that the vent tube (24) has an enlarged lower portion (25) provided with a hinged flap closure (26) which will prevent water from exiting from the vent tube (24), but which will allow air to enter into the interior of the housing unit (20) in a well recognized manner to replace the liquid that is flowing out of the interior of the receptacle (40).

Returning once more to FIG. 3, it can be seen that a cap element (27) having internal threads (28) and a plurality of apertures (29) is operatively secured to the upper portion (22) of the housing unit (20) once the fertilizer disk (30) has been deposited on the mesh screen (23) to captively engage the fertilizer disk within the upper portion (22) of the housing unit (20).

It should also be appreciated at this juncture that the garden sprinkler adapter device (10) that forms the basis of this invention incorporates a number of advantages over the prior art in its design and construction. To begin with, this adapter device (10) is an extremely small and compact unit, wherein the vent tube (24) extends along only a portion of the effective length of the device.

In addition, the recessed mesh screen (23) normally supports the fertilizer disk (30) out of contact with the liquid in the conventional receptacle (40) until such time as the fertilizer is to be dissolved and applied to the plants. This feature substantially prolongs the useful life of the fertilizer disk (30). Furthermore, as has been mentioned previously, the recessed screen (23) allows the fertilizer disk to be loaded into the adapter device (10) either prior to, during, or after the adapter device is operatively engaged with the conventional receptacle (40).

Figure 2:
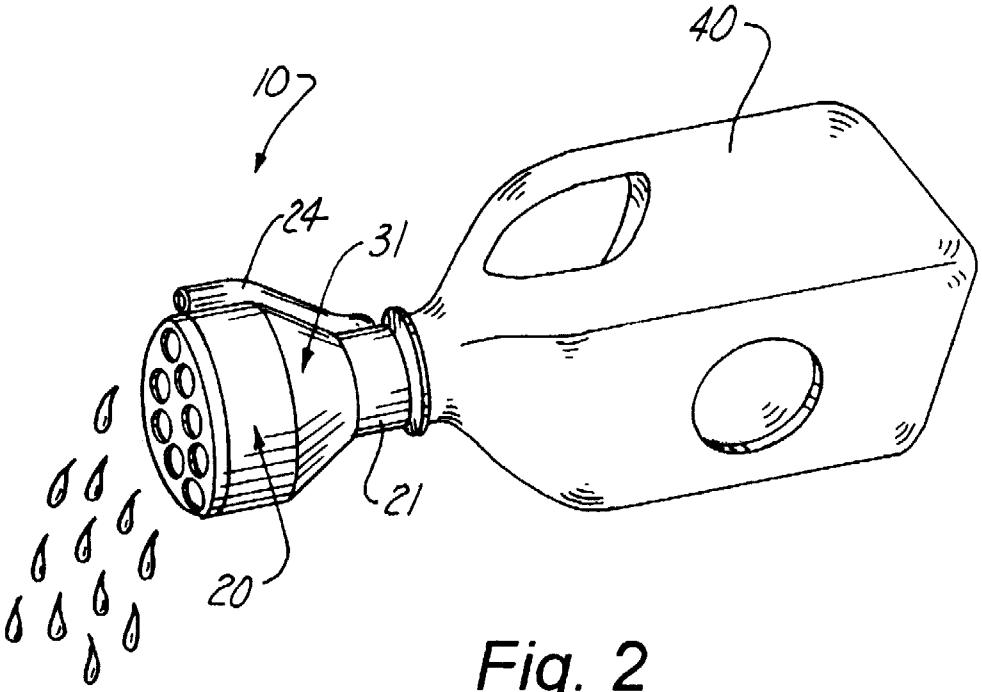
FIG. 2 is a perspective view of the device installed on the liquid receptacle.
Figure 3:
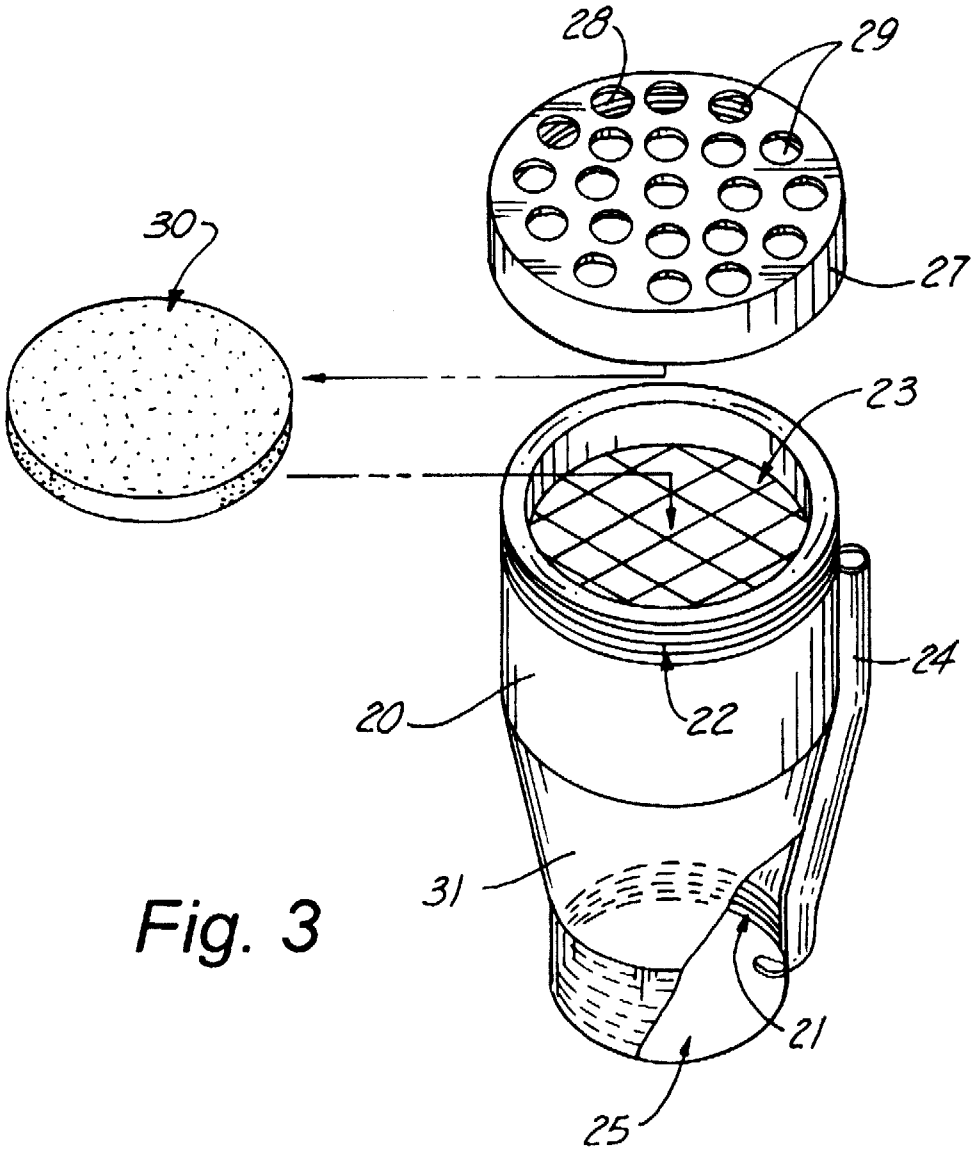
FIG. 3 is an isolated, exploded and partially cut away perspective view of the device.

As can also be seen by reference to FIGS. 1 through 3, the housing unit (20) of the adapter device (10) is also provided with a lower tapered portion (31) that not only facilitates the insertion and removal of the adapter device (10) into the conventional receptacle (40) but also serves as a hand grip surface for directing the spray that issues from the plurality of apertures (29) in the cap element (27).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A garden sprinkler adapter device for use in combination with fertilizer disk and a conventional receptacle having an externally threaded mouth wherein the adapter device consisting of:

an elongated hollow housing unit having a lower portion operably engageable with the mouth of the conventional receptacle and an upper portion dimensioned to receive said fertilizer disk;

screen means associated with said housing unit for suspending the fertilizer disk above the conventional receptacle;

an apertures cap element operatively associated with the upper portion of the housing unit for captively engaging said fertilizer disk; and a vent tube extending between said upper and lower portions of the housing unit wherein the vent tube is disposed substantially on the exterior of the housing unit and one end of the vent tube extends into the housing unit proximate the lower portion of the housing unit and is further provided with a hinged flap closure.

2. The adapter device as in claim 1 wherein the upper portion of the housing unit is externally threaded and the apertured cap element is internally threaded.

3. The adapter device as in claim 1 wherein said screen means is recessed within the upper portion of the housing unit.

4. The adapter device as in claim 1 wherein the lower portion of the housing unit is internally threaded and dimensioned to engage the externally threaded mouth of said conventional receptacle.

* * * * *